US007262554B2

(12) United States Patent
Ballenger et al.

(10) Patent No.: US 7,262,554 B2
(45) Date of Patent: Aug. 28, 2007

(54) LAMP WITH INTEGRAL VOLTAGE CONVERTER HAVING PHASE-CONTROLLED DIMMING CIRCUIT WITH HYSTERESIS CONTROL FOR REDUCING RMS LOAD VOLTAGE

(75) Inventors: Matthew B. Ballenger, Lexington, KY (US); George B. Kendrick, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 374 days.

(21) Appl. No.: 10/967,743

(22) Filed: Oct. 16, 2004

(65) Prior Publication Data

US 2006/0082327 A1 Apr. 20, 2006

(51) Int. Cl.
*H01J 7/44* (2006.01)

(52) U.S. Cl. ..... 315/56; 315/56; 315/291

(58) Field of Classification Search ..... 315/56, 315/209 R, 307, 360, 291
See application file for complete search history.

(56) References Cited

U.S. PATENT DOCUMENTS 3,763,395 A * 10/1973 Shilling et al. ..... 315/307
3,869,631 A 3/1975 Anderson et al. ..... 313/217
4,876,495 A * 10/1989 Palanisamy et al. ..... 320/106
6,147,457 A * 11/2000 Lohn et al. ..... 315/209 R
6,208,090 B1 * 3/2001 Skilskyj et al. ..... 315/360
6,445,133 B1 9/2002 Lin et al. ..... 315/57
2003/0127994 A1 * 7/2003 Patchornik et al. ..... 315/291

* cited by examiner

*Primary Examiner*—Thuy V. Tran
*Assistant Examiner*—Dieu Hien T Duong
(74) *Attorney, Agent, or Firm*—Carlo S. Bessone

(57) ABSTRACT

An incandescent lamp includes a lamp voltage conversion circuit within the lamp and connected to a lamp terminal, where the voltage conversion circuit converts a first line voltage at the lamp terminal to a second RMS load voltage usable by a light emitting element of the lamp. The voltage conversion circuit includes a triac phase-controlled dimming circuit, which in turn includes a hysteresis control network. The voltage conversion circuit may be an integrated circuit that is in the lamp base and connected between the lamp terminal and the light emitting element. The triac phase-controlled dimming circuit may be built for a specific line voltage.

14 Claims, 5 Drawing Sheets

LAMP WITH INTEGRAL VOLTAGE CONVERTER HAVING PHASE-CONTROLLED DIMMING CIRCUIT WITH HYSTERESIS CONTROL FOR REDUCING RMS LOAD VOLTAGE

BACKGROUND OF THE INVENTION

The present invention is directed to a lamp with an integral voltage converter that converts line voltage to a voltage suitable for lamp operation.

Some lamps operate at a voltage lower than a line (or mains) voltage of, for example, 120V or 220V, and for such lamps a voltage converter that converts line voltage to a lower lamp operating voltage must be provided. The voltage converter may be provided in a fixture to which the lamp is connected or within the lamp itself. U.S. Pat. No. 3,869,631 is an example of the latter, in which a diode is provided in the lamp base for clipping the line voltage to reduce RMS load voltage at the light emitting element. U.S. Pat. No. 6,445,133 is another example of the latter, in which transformer circuits are provided in the lamp base for reducing the load voltage at the light emitting element.

Factors to be considered when designing a voltage converter that is to be located within the lamp include the sizes of the lamp and voltage converter, costs of materials and production, production of a potentially harmful DC load on a source of power for installations of multiple lamps, and the operating temperature of the lamp and an effect of the operating temperature on a structure and operation of the voltage converter.

SUMMARY OF THE INVENTION

An object of the present invention is to provide a novel lamp that includes within the lamp a voltage converter for converting line voltage to a lower RMS load voltage, where the voltage converter includes a triac phase-controlled dimming circuit. The dimming circuit includes a hysteresis control network.

The phase-controlled dimming circuit may include, for example, a resistor and capacitor in a first RC network, a diac connected between the resistor and capacitor of the first RC network, and a triac that is triggered by the diac when breakover voltage is achieved at the capacitor. The hysteresis control network may include a second RC network connected in parallel with the first RC network or a further network that includes a resistor and diode connected to each other in series.

The voltage converter may be an integrated circuit in a lamp base and connected between a lamp terminal and a light emitting element housed in the lamp light transmitting envelope.

DESCRIPTION OF PREFERRED EMBODIMENTS

Figure 1:
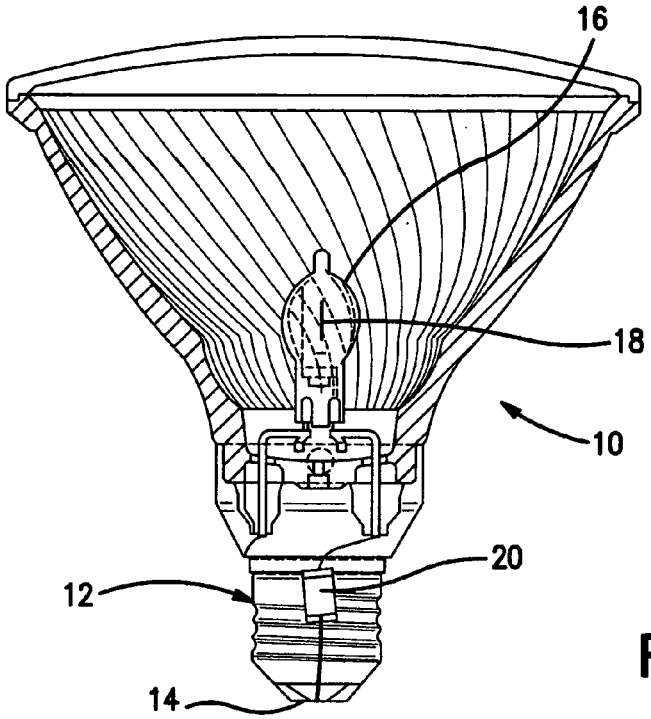
FIG. 1 is a partial cross section of an embodiment of a lamp of the present invention.

With reference to FIG. 1, a lamp 10 includes a base 12 with a lamp terminal 14 that is adapted to be connected to line (mains) voltage, a light-transmitting envelope 16 attached to the base 12 and housing a light emitting element 18 (an incandescent filament in the embodiment of FIG. 1), and a lamp voltage conversion circuit 20 for converting a line voltage at the lamp terminal 14 to a lower lamp operating voltage. The lamp voltage conversion circuit 20 is within the base 12 and connected between the lamp terminal 14 and the light emitting element 18. The voltage conversion circuit 20 may be an integrated circuit in a suitable package as shown schematically in FIG. 1.

While FIG. 1 shows the lamp voltage conversion circuit 20 in a parabolic aluminized reflector (PAR) halogen lamp, the lamp voltage conversion circuit 20 may be used in any incandescent lamp when placed in series between the light emitting element (e.g., filament) and a connection (e.g., lamp terminal) to a line voltage.

Figure 2:
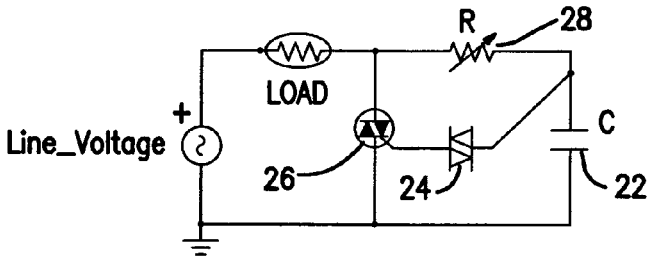
FIG. 2 PRIOR ART
FIG. 2 is a schematic circuit diagram of a phase-controlled dimming circuit of the prior art.

The voltage conversion circuit 20 includes a phase-controlled dimming circuit, derived from a conventional phase-controlled dimming circuit such as shown in FIG. 2 that has a capacitor 22, a diac 24, a triac 26 that is triggered by the diac 24, and resistor 28. In a conventional dimming circuit, the resistor 28 may be a potentiometer that sets a resistance in the circuit to control a phase at which the triac 26 fires. A dimming circuit is a two terminal device intended to reside in series with a relatively small resistive load.

Figure 3:
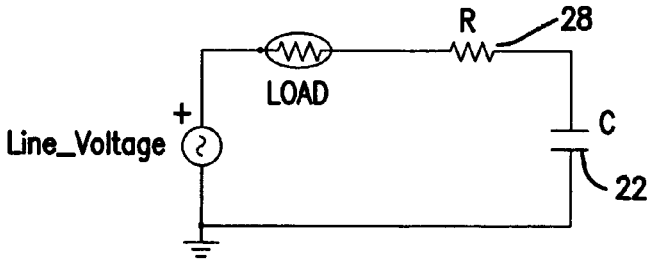
FIG. 3 PRIOR ART
FIG. 3 is a schematic circuit diagram of the phase-controlled dimming circuit of FIG. 2 showing an effective state in which the triac is not yet triggered.

In operation, a dimming circuit such as shown in FIG. 2 has two states. In the first state the diac 24 and triac 26 operate in the cutoff region where virtually no current flows. Since the diac and triac function as open circuits in this state, the result is an RC series network such as illustrated in FIG. 3. Due to the nature of such an RC series network, the voltage across the capacitor 22 leads the line voltage by a phase angle that is determined by the resistance and capacitance of the RC series network. The magnitude of the capacitor voltage is also dependent on these values.

Figure 4:
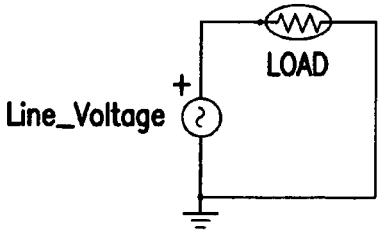
FIG. 4 PRIOR ART
FIG. 4 is a schematic circuit diagram of the phase-controlled dimming circuit of FIG. 2 showing an effective state in which the triac has been triggered.

The voltage across the diac 24 is analogous to the voltage drop across the capacitor 22 and thus the diac will fire once breakover voltage is achieved across the capacitor. The triac 26 fires when the diac 24 fires. Once the diac has triggered the triac, the triac will continue to operate in saturation until the diac voltage approaches zero. That is, the triac will continue to conduct until the line voltage nears zero crossing. The virtual short circuit provided by the triac becomes the second state of the dimming circuit, such as illustrated in FIG. 4.

Figure 5:
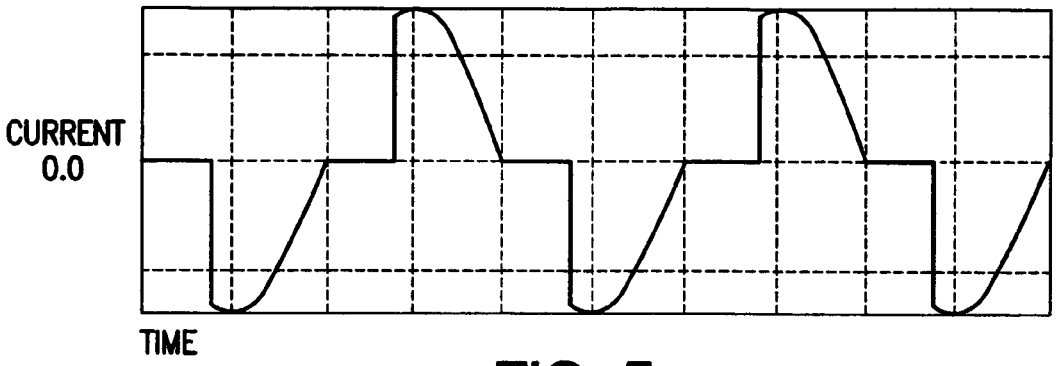
FIG. 5 PRIOR ART
FIG. 5 is a graph illustrating current clipping in the phase-controlled dimming circuit of FIG. 2.
Figure 6:
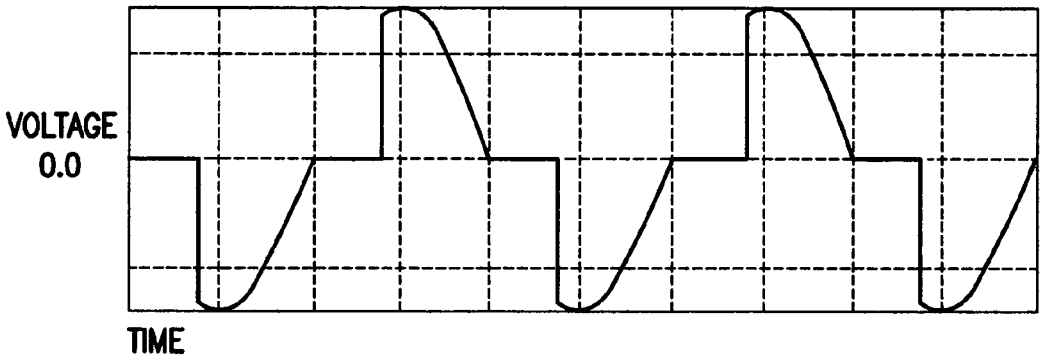
FIG. 6 PRIOR ART
FIG. 6 is a graph illustrating voltage clipping in the phase-controlled dimming circuit of FIG. 2.

Triggering of the triac 26 in the dimming circuit is phase-controlled by the RC series network and the leading portion of the mains voltage waveform is clipped until triggering occurs, as illustrated in FIGS. 5-6. A load attached to the dimming circuit experiences this clipping in both voltage and current due to the relatively large resistance in the dimming circuit.

Accordingly, the RMS voltage and current seen by the load are determined by the resistance and capacitance values in the dimming circuit since the phase at which the clipping occurs is determined by the RC series network and since the RMS voltage and current depend on how much energy is removed by the clipping.

Figure 7:
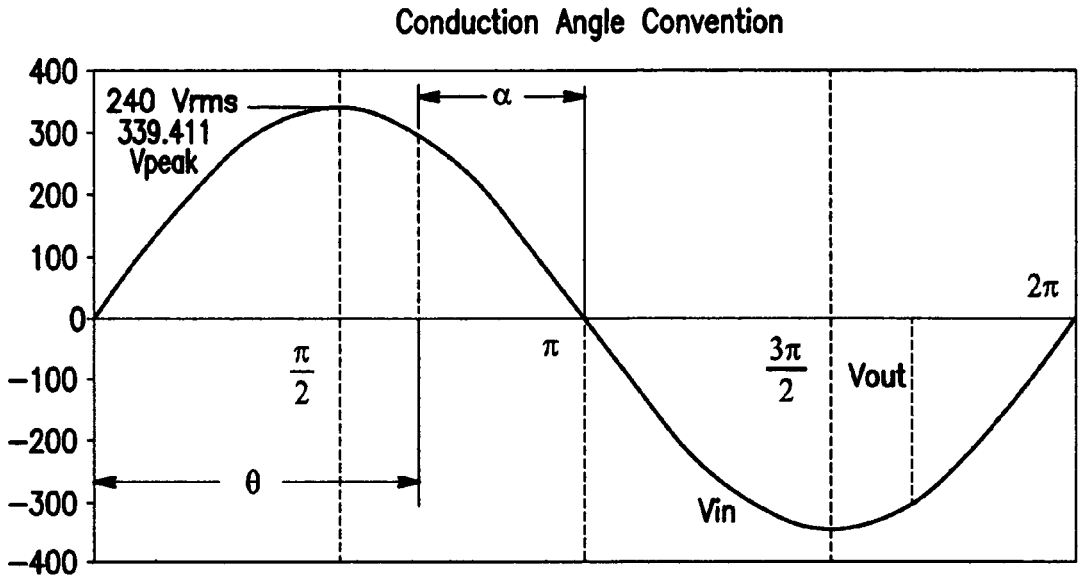
FIG. 7 is a graph showing the conduction angle convention adopted herein.

Line voltage may vary from location to location up to about 10% and this variation can cause a variation in RMS load voltage in the lamp by an amount that can vary light levels, shorten lamp life, or even cause immediate failure. For example, if line voltage were above the standard for which the voltage conversion circuit was designed, the triac 26 may trigger early thereby increasing RMS load voltage. In a halogen incandescent lamp, it is particularly desirable to have a constant RMS load voltage By way of background and with reference to FIG. 7, clipping is characterized by a conduction angle $\alpha$ and a delay angle $\theta$. The conduction angle is the phase between the point on the load voltage/current waveforms where the triac begins conducting and the point on the load voltage/current waveform where the triac stops conducting. Conversely, the delay angle is the phase delay between the leading line voltage zero crossing and the point where the triac begins conducting.

Define $V_{irrms}$ as RMS line voltage, $V_{ip}$ as peak line voltage, $V_{orms}$ as RMS load voltage, $V_{op}$ as peak load voltage, T as period, and $\omega$ as angular frequency (rad) with $\omega=2\pi f$. The RMS voltage is determined from the general formula:

$$V_{orms} = \sqrt{\frac{1}{T}\int_0^T v^2(t)\,dt}$$

Applying the conduction angle defined above yields:

$$V_{orms} = \sqrt{\frac{1}{2\pi}\left[\int_{\pi-\alpha}^{\pi} V_{ip}^2\sin^2(\omega)\,d\omega + \int_{2\pi-\alpha}^{2\pi} V_{ip}^2\sin^2(\omega)\,d\omega\right]}$$

$$V_{orms} = \sqrt{\frac{1}{2\pi}(2)\left[\int_{\pi-\alpha}^{\pi} V_{ip}^2\sin^2(\omega)\,d\omega\right]}$$

$$V_{orms} = \sqrt{\frac{V_{ip}^2}{\pi}\left(\frac{\alpha-\sin\alpha\cos\alpha}{2}\right)}$$

$$V_{orms} = V_{ip}\sqrt{\frac{\alpha-\sin\alpha\cos\alpha}{2\pi}}$$

This relationship can also be used to define $V_{ip}$ in terms of $V_{orms}$ and $\alpha$:

$$V_{ip} = V_{orms}\sqrt{\frac{2\pi}{\alpha-\sin\alpha\cos\alpha}}$$

Figure 8:
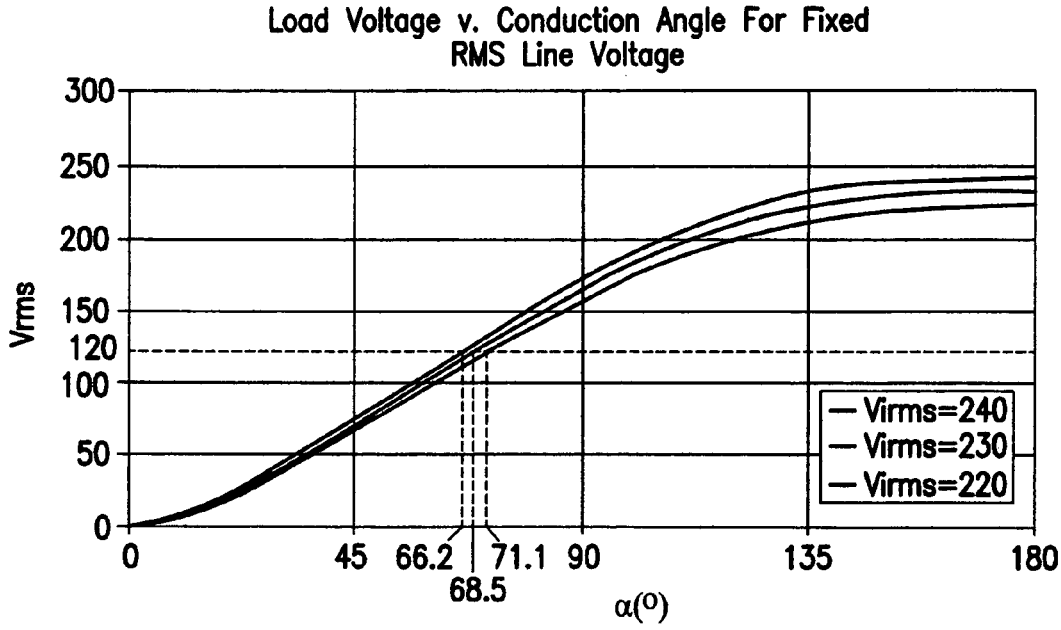
FIG. 8 is a graph showing the relationship of load voltage to conduction angle for several RMS line voltages.
Figure 9:
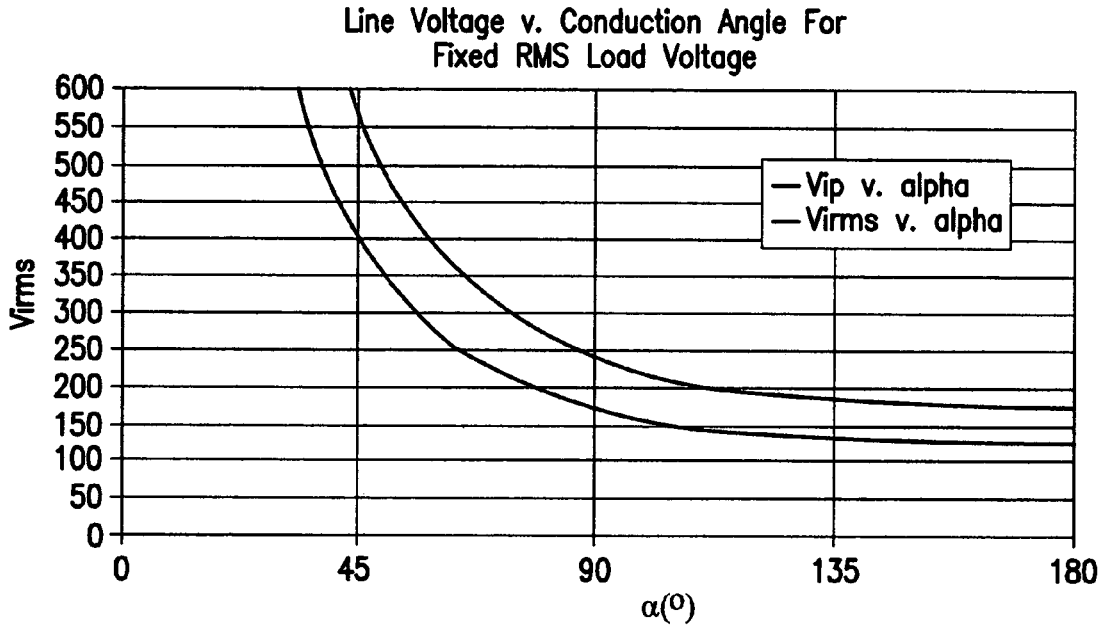
FIG. 9 is a graph showing the relationship of line voltage to conduction angle for fixed RMS load voltages.

Using these equations, the relationship between peak line voltage, RMS line voltage, RMS load voltage, and conduction angle $\alpha$ may be displayed graphically. FIG. 8 shows $V_{orms}$ as a function of conduction angle $\alpha$ for line voltages 220V, 230V and 240V. Note that small changes in line voltage result in larger changes in RMS load voltage. FIG. 9 shows the relationship of line voltage to conduction angle for fixed RMS load voltages. A lamp light emitting element (e.g., filament) is designed to operate at a particular load voltage, such as 120Vrms. As seen these graphs, the conduction angle required to achieve this load voltage depends on the RMS line voltage and the relationship is not linear. Changes in the line voltage are exaggerated at the load.

Figure 10:
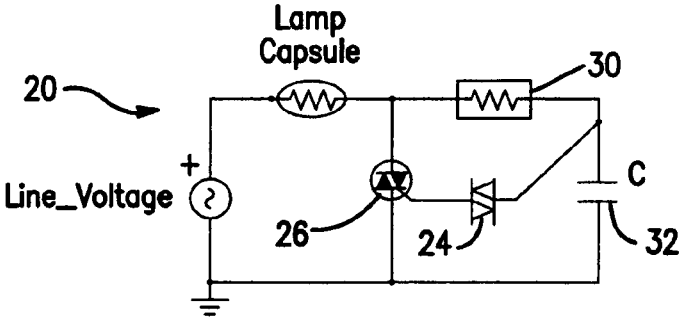
FIG. 10 is a schematic circuit diagram of a phase-controlled dimming circuit of an embodiment of the present invention.

With reference to FIG. 10, an option for solving this problem is to design different voltage conversion circuits 20 for particular line voltages and to incorporate the different circuits in a family of lamps that are sold for use with the particular line voltages. Since line voltage does not vary very much at a particular location, particular lamps with particular voltage conversion circuits could be provided for particular locations once the line voltage for the location is known. Each voltage conversion circuit would include a resistor 30 and a capacitor 32 whose resistance and capacitance would be selected, based on the anticipated line voltage, to provide a conduction angle that provides the RMS load voltage appropriate for the lamp. For example, the RC values in one circuit could be optimized for 220V operation, another circuit for 230V and so on. Line frequency (50 Hz and 60 Hz) also needs to be considered as the line frequency also affects circuit performance.

By way of further explanation, recall that the conduction angle of triac triggering is dependent on the RC series portion of the dimming circuit. When selecting the resistance and capacitance for each voltage conversion circuit, it is preferable to pick an appropriate capacitance and optimize the resistance. Consider how varying resistance affects triggering. In a simple RC series circuit (e.g., FIG. 3), the circuit resistance $R_T$ will be load resistance plus the resistance of the resistor. In application, the load resistance is very small compared to the resistance of the resistor and may be ignored. Using Kirchoff's voltage law the line source voltage $V_S$ can be written in terms of loop current I and element impedances:

$$V_S = I\left[R_T + \frac{1}{j\omega C}\right]$$

which may be rewritten:

$$I = \frac{j\omega C V_S}{j\omega R_T + 1}$$

This equation may be used to write an expression for the voltage across the capacitor:

$$V_C = I\frac{1}{j\omega C} = \frac{j\omega C V_S}{j\omega R_T C + 1}\left[\frac{1}{j\omega C}\right] = \frac{V_S(1 - j\omega R_T C)}{\omega^2 R_T^2 C^2 + 1}$$

The magnitude and phase relation of capacitor voltage with respect to reference line voltage can be calculated:

$$\mathrm{Im}\{V_c\} = \frac{-V_s \omega R_1 C}{\omega^2 R_T^2 C^2 + 1}$$

$$\mathrm{Re}\{V_c\} = \frac{V_S}{\omega^2 R_T^2 C^2 + 1}$$

$$|V_C| = \sqrt{\mathrm{Im}^2\{V_C\} + \mathrm{Re}^2\{V_C\}} = \frac{V_S}{\sqrt{\omega^2 R_T^2 C^2 2_{+1}}}$$

$$\angle\Theta_C = \tan^{-1}\left[\frac{\mathrm{Im}\{V_C\}}{\mathrm{Re}\{V_C\}}\right] = \tan^{-1}(-\omega R_T C)$$

The equations for capacitor voltage magnitude and phase delay show how the value of $R_T$ affects triggering. Diac triggering occurs (and thus triac triggering also occurs) when $V_C$ reaches diac breakover voltage. If capacitance and circuit frequency are fixed values, then $R_T$ and $V_S$ are the only variables that will affect the time required for $V_C$ to reach the diac breakover voltage that determines the RMS load voltage. Accordingly, an appropriate resistance may be selected for each voltage conversion circuit.

Figure 11:
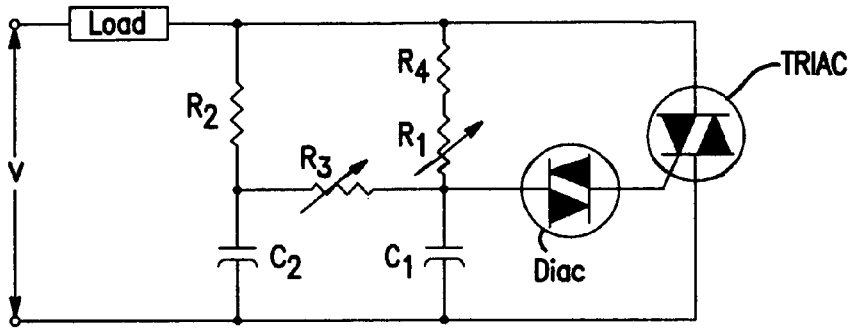
FIG. 11 PRIOR ART
FIG. 11 is a schematic circuit diagram of a conventional hysteresis control network.
Figure 12:
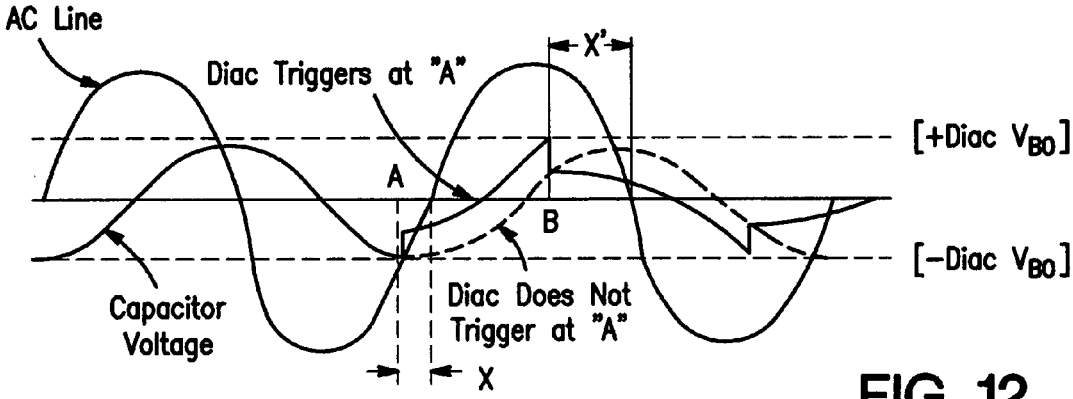
FIG. 12 PRIOR ART
FIG. 12 is a graph showing the relationship of line voltage to conduction angle and the effect of hysteresis.

The performance of lamps with line-voltage-specific voltage conversion circuits may be improved by providing hysteresis control. A conventional circuit for hysteresis control is shown in FIG. 11 taken from the Teccor Electronics Thyristor Product Catalog. Operation of this circuit is depicted in FIG. 12.

Figure 13:
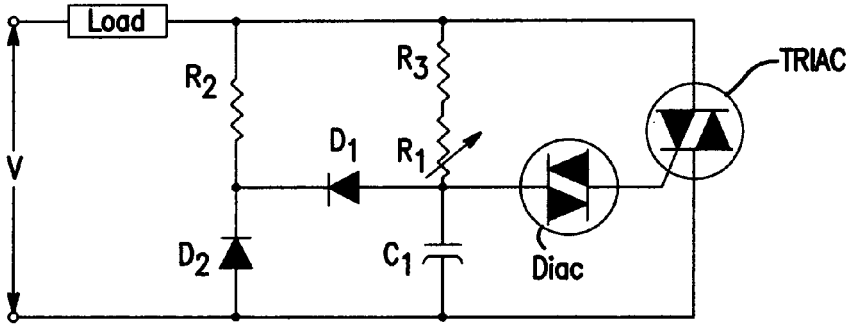
FIG. 13 PRIOR ART
FIG. 13 is a schematic circuit diagram of a further conventional hysteresis control network.
Figure 14:
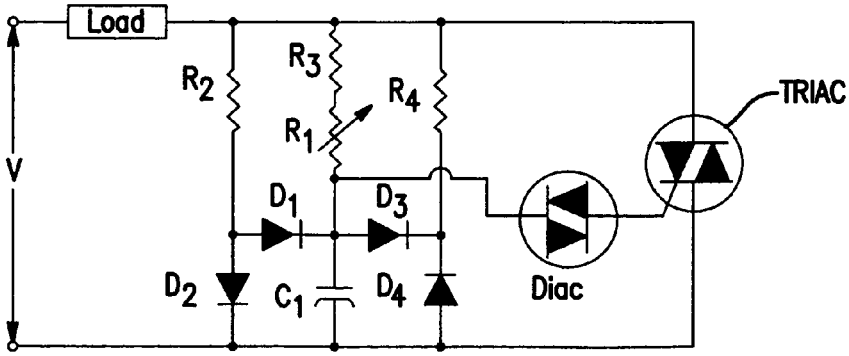
FIG. 14 PRIOR ART
FIG. 14 is a schematic circuit diagram of yet another conventional hysteresis control network.

Hysteresis control may be provided by adding a second RC series network to the circuit of FIG. 10, such as shown by the addition of resistors R2 and capacitor C2 in a second RC series network to the first RC series network of resistor R1/R4 and capacitor C1 in FIG. 11. The two RC series networks may be connected by a resistor R3 at the node that is connected to and triggers the diac. The addition of the second RC series network reduces the hysteresis shown in FIG. 12 (the difference between phases X and X'). The hysteresis may be almost entirely eliminated by replacing resistor R3 with a diode D1 and replacing capacitor C2 with diode D2 as shown in FIG. 13, which is useful for symmetrical firing. The circuit of FIG. 14 is useful for resistive loads since the firing angle is not symmetrical throughout the range. The circuit of FIG. 14 includes a third network connected in parallel with the second network, where the third network includes a resistor R4 and a diode D4 connected to each other in series, and where the diac is connected between R4 resistor and diode D4 of the third network through a further diode D3. The circuits of FIGS. 13 and 14 are also from the Teccor Electronics Thyristor Product Catalog. Other equivalent hysteresis control networks may also be suitable.

In a first embodiment, the lamp includes a lamp voltage converter, such as conversion circuit 20, in the lamp 10 and connected between a lamp terminal 14 and a light emitting element 18, where the voltage converter converts a first line voltage at the lamp terminal to a load voltage that operates the light emitting element, and where the voltage converter includes a phase-controlled dimming circuit for reducing an RMS load voltage at the light emitting element and the phase-controlled dimming circuit includes means for reducing hysteresis in the phase-controlled dimming circuit. The means for reducing hysteresis includes the hysteresis control networks disclosed above and equivalents thereof.

In a second embodiment, an incandescent lamp includes a lamp voltage conversion circuit 20 within the lamp and connected to a lamp terminal, where the voltage conversion circuit converts a first line voltage at the lamp terminal to a load voltage. The voltage conversion circuit includes a phase-controlled dimming circuit for reducing an RMS load voltage, where the phase-controlled dimming circuit includes a first RC network with a resistor 30 and a capacitor 32 connected in series, a diac 24 with a first terminal connected between the resistor and the capacitor, and a triac 26 connected in parallel with the first RC network and that is triggered by a second terminal of the diac when breakover voltage is achieved at the capacitor. The voltage conversion circuit of this embodiment also includes a second network connected in parallel with the first RC network, where the second network has a resistor R2 and second element C2/D2 connected in series and the first terminal of the diac is connected between the resistor and the second element of the second network.

While embodiments of the present invention have been described in the foregoing specification and drawings, it is to be understood that the present invention is defined by the following claims when read in light of the specification and drawings.

We claim:

1. A lamp comprising a lamp voltage converter in the lamp and connected between a lamp terminal and a light emitting element, said voltage converter converting a first line voltage at said lamp terminal to a load voltage that operates said light emitting element, said voltage converter including a phase-controlled dimming circuit for reducing an RMS load voltage at said light emitting element, the phase-controlled dimming circuit including means for reducing hysteresis in the phase-controlled dimming circuit.

2. The lamp of claim 1, wherein said phase-controlled dimming circuit comprises a first RC network with a resistor and a capacitor, a diac connected between the resistor and the capacitor, and a triac connected in parallel with the first RC network.

3. The lamp of claim 2, wherein said means for reducing hysteresis comprises a second RC network connected in parallel with said first RC network and wherein said diac is connected between a resistor and a capacitor connected in series in said second RC network.

4. The lamp of claim 2, wherein said means for reducing hysteresis comprises a second network connected in parallel with said first RC network, said second network including a resistor and a diode connected to each other in series, and wherein said diac is connected between the resistor and the diode of said second network.

5. The lamp of claim 4, wherein said means for reducing hysteresis further comprises a third network connected in parallel with said second network, said third network including a resistor and a diode connected to each other in series, and wherein said diac is connected between the resistor and the diode of said third network.

6. The lamp of claim 2, wherein a resistance of said resistor in said first RC network is fixed and is based on the first line voltage at said lamp terminal.

7. The lamp of claim 1, further comprising a base and a light-transmitting envelope, and wherein said voltage converter is within said base.

8. The lamp of claim 7, wherein said voltage converter is an integrated circuit.

9. An incandescent lamp comprising:

a lamp voltage conversion circuit within the lamp and connected to a lamp terminal, said voltage conversion circuit converting a first line voltage at said lamp terminal to a load voltage; and said voltage conversion circuit including a phase-controlled dimming circuit for reducing an RMS load voltage, said phase-controlled dimming circuit comprising, a first RC network with a resistor and a capacitor connected in series, a diac with a first terminal connected between the resistor and the capacitor, and a triac connected in parallel with the first RC network and that is triggered by a second terminal of said diac when breakover voltage is achieved at said capacitor, and a second network connected in parallel with said first RC network, said second network having a resistor and second element connected in series, said first terminal of said diac being connected between the resistor and the second element of said second network.

10. The lamp of claim 9, further comprising a base and a light-transmitting envelope, and wherein said voltage conversion circuit is within said base.

11. The lamp of claim 9, wherein said second element of said second network is a capacitor and wherein said first terminal of said diac is connected between the resistor and the capacitor of said second network through a resistor.

12. The lamp of claim 9, wherein said second element of said second network is a diode and wherein said first terminal of said diac is connected between the resistor and the diode of said second network through a further diode.

13. The lamp of claim 12, wherein said phase-controlled dimming circuit further comprises a third network connected in parallel with said second network, said third network including a resistor and a diode connected to each other in series, and wherein said first terminal of said diac is connected between the resistor and the diode of said third network through yet a further diode.

14. The lamp of claim 9, wherein said voltage conversion circuit is an integrated circuit.

* * * * *